US005158300A

United States Patent [19]

Aoyama

[11] Patent Number: 5,158,300

[45] Date of Patent: Oct. 27, 1992

[54] GOLF BALL

[75] Inventor: Steven Aoyama, Marion, Mass.

[73] Assignee: Acushnet Company, New Bedford, Mass.

[21] Appl. No.: 782,035

[22] Filed: Oct. 24, 1991

[51] Int. Cl.[5] ..... A63B 37/12

[52] U.S. Cl. ..... 273/232; 40/327

[58] Field of Search ..... 273/232; 40/327

[56] References Cited

U.S. PATENT DOCUMENTS

| | | | |
|---|---|---|---|
| 878,254 | 2/1908 | Taylor | 273/232 |
| 4,979,747 | 12/1990 | Jonkouski | 273/232 |
| 5,060,954 | 10/1991 | Gobush | 273/232 |

FOREIGN PATENT DOCUMENTS

| | | | |
|---|---|---|---|
| 2234178 | 1/1991 | United Kingdom | 273/232 |

*Primary Examiner*—George J. Marlo
*Attorney, Agent, or Firm*—Pennie & Edmonds

[57] ABSTRACT

A golf ball having three or more sets of dimples with each set having substantially the same dimple diameter and each dimple of each set having the same dimple edge angle. Each set of dimples has diameters which differ substantially from each other set. Golf balls having 50% to 80% or more of their surfaces covered with dimples are within the present invention.

5 Claims, 1 Drawing Sheet

GOLF BALL

BACKGROUND OF THE INVENTION

In the past, golf ball dimple designs typically included 250 to 500 dimples, all having the same specific diameter, depth, and shape, usually chosen to maximize the aerodynamic effectiveness of the dimples. Today, it is not uncommon to find several different sizes of dimples on a single ball. In these designs, the different-sized dimples are typically configured to all have the same depth, or the same enclosed volume, or the same depth-/diameter ratio (see U.S. Pat. No. 5,033,750), or with no particular relationship at all. None of these schemes maximizes the aerodynamic effectiveness of each dimple size.

SUMMARY OF THE INVENTION

Broadly, the present invention comprises a golf ball having an outer surface periphery with a plurality of sets of dimples positioned therein wherein each dimple set has dimples of a selected diameter which diameter differs from each other set and where each and every dimple set has an edge or edges which diverge from the outer surface at substantially the same angle.

It is a feature that a ball have dimples over 50 percent and preferably about 70 to about 80 percent of the outer surface of the ball.

DESCRIPTION OF THE PREFERRED EMBODIMENT

Figure 1:
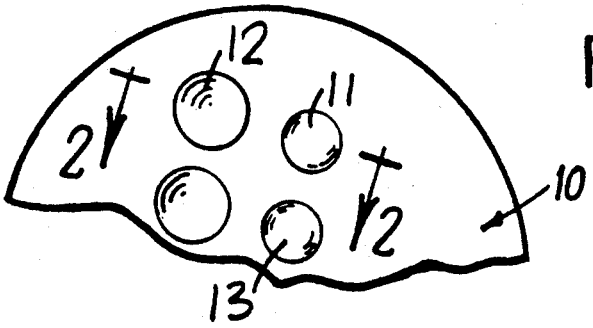
FIG. 1 is a perspective view of unfinished ball with dimples of varying diameter.
Figure 2:
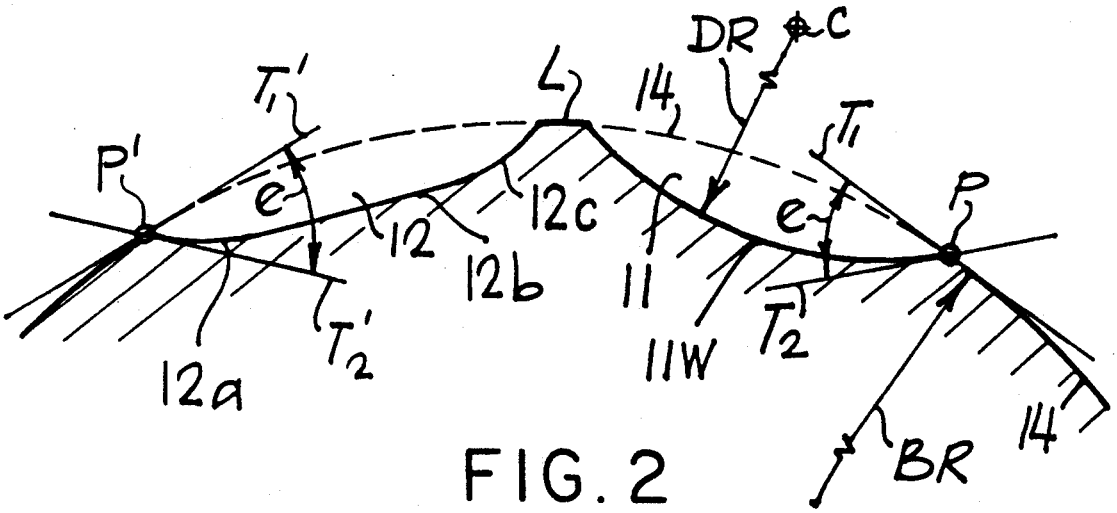
FIG. 2 is a sectional view taken along line 2—2 of FIG. 1 through the center of two adjacent dimples.

In FIGS. 1 and 2, ball 10 has a plurality of dimples 11, 12, 13, etc. with dimples 11 and 12 shown in section in FIG. 2. Dimple 11 ia spherical concave dimple with spherical wall 11. Wall 11w is a segment of a sphere with center C and radius DR. The edge angle e of dimple 11 is measured at point P where wall 11w diverges from ball periphery surface 14. A line tangent to ball periphery surface 14 at P determines tangent $T_1$. $T_2$ is a tangent to dimple wall 11w at point P. Dimple edge angle e is the angle between tangents $T_1$ and $T_2$. Also shown is non-dimple area or land L.

Adjacent dimple 11 is a saucer shaped dimple 12 which includes dimple wall arcuate areas 12*a* and 12*c* and dimple bottom area 12*b*. The edge angle of this non-spherical dimple 12, which has a larger diameter than dimple 11, is angle e', the angle between tangents $T_1'$ and $T_2'$. Tangent $T_1'$ is a line tangent to ball periphery surface 14 at point P', where dimple wall area 12*a* diverges from surface 14. Tangent $T_2'$ is a line tangent to dimple wall area 12*a* at point P'. Edge angle e is substantially equal to edge angle e'.

Preferably edge angles e and e' are between 14 to 22 degrees for optimum aerodynamic ball performance with balls having 70–80 percent dimple coverage. Where dimple coverage is about 50 percent or more dimple edge angle of 14–26 degrees is preferred. While the edge angles of dimples may vary a small amount where all dimple angles fall within a range of about 2 degrees the dimple angles are considered to be substantially the same.

Figure 3:
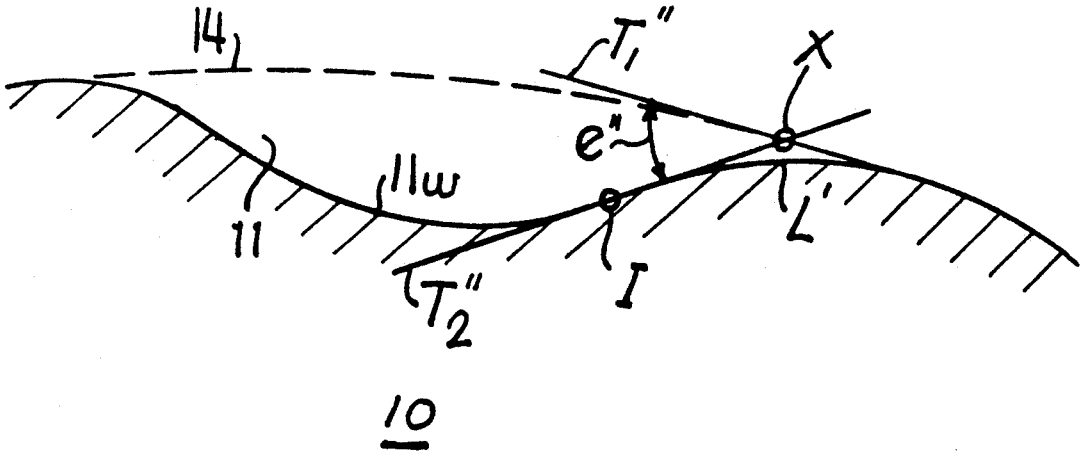
FIG. 3 is a partial sectional view of a dimple of a finished ball including layers of paint and a clear coat.

Turning to FIG. 3, ball 10 is shown as a finished ball including layers of paint and clear coat which creates a varied curvature at the demarcation between ball periphery surface 14 and dimple wall 11w. This curvature makes the location of the dimple edge indistinct. In this case, the edge angle e" is defined to be the angle between tangents $T_1''$ and $T_2''$. $T_2''$ is the tangent to the dimple wall 11w at the inflection point I. $T_1''$ is the tangent to the ball periphery surface 14 at point X which is the intersection of $T_2''$ and periphery 14.

Dimple edge angles, diameters, depths, and other dimensions are normally measured on an unfinished molded ball or the master pattern used to create the ball mold, which usually are substantially the same. The unfinished ball is then coated with thin layers of paint and/or clearcoat, which coats vary in thickness and tend to be slightly thinner at the dimple edges. Thus, the edge angles and other dimple dimensions on a finished ball may vary somewhat from the unfinished ball or the master pattern.

The edge angles of the present invention are determined using unfinished ball or master pattern dimensions.

I claim:

1. A golf ball having three or more sets of dimples on its surface with all dimples within a set having substantially the same diameter and each set diameter differing substantially from each other set diameter and in which each set has substantially the same dimple edge angle.

2. A golf ball of claim 1 having dimples over 50% or more of its surface.

3. A golf ball of claim 2 in which the edge angles of the sets are all within two degrees of each other and all such edge angles are in the range of 14–26 degrees.

4. A golf ball of claim 1 having dimples over about 70% to about 80% of the ball surface.

5. A golf ball of claim 4 in which the edge angles of the dimples are all within two degrees of each other and all such edge angles are in the range of 14 to 22 degrees.

* * * * *